US007074143B2

(12) United States Patent
Czemske et al.

(10) Patent No.: US 7,074,143 B2
(45) Date of Patent: Jul. 11, 2006

(54) ARROW FLETCHING SYSTEM AND METHOD FOR ATTACHING ARROW FLETCHING SYSTEM TO AN ARROW SHAFT

(75) Inventors: Michael M. Czemske, Lyons, IL (US); Gregory C. Smith, Geneva, IL (US)

(73) Assignee: New Archery Products Corp., Forest Park, IL (US)

( * ) Notice: Subject to any disclaimer, the term of this patent is extended or adjusted under 35 U.S.C. 154(b) by 0 days.

(21) Appl. No.: 10/894,479

(22) Filed: Jul. 20, 2004

(65) Prior Publication Data

US 2006/0019780 A1 Jan. 26, 2006

(51) Int. Cl.
*F42B 6/06* (2006.01)

(52) U.S. Cl. ..... 473/586

(58) Field of Classification Search ..... 473/578, 473/585, 586

See application file for complete search history.

(56) References Cited

U.S. PATENT DOCUMENTS

| | | | | |
|---|---|---|---|---|
| 219,881 | A | 9/1879 | Streeter | |
| 2,193,397 | A | 3/1940 | Dykes | |
| 2,277,743 | A | 3/1942 | Crossman | |
| 2,525,332 | A | 10/1950 | Alger et al. | |
| 2,782,036 | A | 2/1957 | Folberth, Jr. et al. | |
| 2,830,818 | A * | 4/1958 | Otto | 473/586 |
| 2,887,319 | A | 5/1959 | Lay | |
| 2,899,773 | A | 8/1959 | Lockwood | |
| 2,976,042 | A | 3/1961 | Barnett | |
| 3,106,400 | A | 10/1963 | Zwickey | |
| 3,539,187 | A | 11/1970 | Smith | |
| 3,595,579 | A | 7/1971 | Benoit | |
| 3,596,910 | A | 8/1971 | Rizzo | |
| 3,672,677 | A | 6/1972 | Moore | |
| 3,672,678 | A | 6/1972 | Rizzo | |
| 3,749,403 | A | 7/1973 | Austin et al. | |
| 3,756,602 | A | 9/1973 | Carella | |
| 3,815,916 | A * | 6/1974 | Meszaros | 473/586 |
| D232,356 | S | 8/1974 | Melton | |
| 3,897,062 | A | 7/1975 | Christensen | |
| 3,982,762 | A | 9/1976 | Milicic | |
| 4,003,576 | A | 1/1977 | Carella | |
| 4,012,043 | A | 3/1977 | Carella | |
| 4,088,323 | A | 5/1978 | Munger | |
| 4,204,307 | A * | 5/1980 | Pfetzing | 29/407.09 |

(Continued)

FOREIGN PATENT DOCUMENTS

| | | |
|---|---|---|
| JP | 2003-21499 | 1/2003 |

OTHER PUBLICATIONS

Rouge, Dave: U.S. Appl. No. 60/533,039, entitled: *Arrow Fletch Device*, (3 pages).

(Continued)

*Primary Examiner*—John A. Ricci
(74) *Attorney, Agent, or Firm*—Pauley Petersen & Erickson

(57) ABSTRACT

A fletching system including a sleeve positionable about an outer surface of an arrow shaft and at least one archery vane mounted to an outer surface of the sleeve. The sleeve has an initial inner diameter greater than an outer diameter of the arrow shaft and the sleeve is shrinkable to secure the fletching system to the arrow shaft. Methods for constructing a fletching system include mounting a shrinkable sleeve and at least one archery vane on an outer surface of the shrinkable sleeve and also attaching the fletching system with respect to an archery arrow.

17 Claims, 5 Drawing Sheets

U.S. PATENT DOCUMENTS 4,234,192 A * 11/1980 Salamone ..... 473/586
4,392,654 A 7/1983 Carella
4,477,084 A 10/1984 Austin
4,488,728 A 12/1984 Humphrey
4,502,692 A 3/1985 Humphrey
4,510,109 A 4/1985 Carella
4,534,568 A 8/1985 Tone
4,565,377 A 1/1986 Troncoso, Jr. et al.
4,583,745 A * 4/1986 Ladner ..... 473/586
4,615,552 A 10/1986 Bengtson
4,986,550 A 1/1991 Segovia
5,024,448 A 6/1991 Barrie
5,039,110 A 8/1991 Honda
5,064,202 A 11/1991 Barner
5,112,062 A 5/1992 Pratt
5,119,797 A 6/1992 Anderson
5,213,090 A 5/1993 Tone
5,257,809 A 11/1993 Carrizosa
5,311,855 A 5/1994 Basik
5,427,385 A * 6/1995 Conrad et al. ..... 473/586
5,439,231 A 8/1995 Roberts et al.
5,443,272 A * 8/1995 Vincent, Sr. ..... 473/578
5,443,273 A * 8/1995 Lovorn ..... 473/586
5,465,981 A 11/1995 Klaus
5,613,688 A 3/1997 Carella
5,842,942 A 12/1998 Doht et al.
5,846,147 A 12/1998 Basik
5,871,410 A 2/1999 Simo et al.
5,897,449 A 4/1999 Roberts et al.
5,951,419 A 9/1999 Cameneti
6,142,896 A 11/2000 Simo et al.
6,203,457 B1 3/2001 Snook
6,220,978 B1 4/2001 Schroeder
6,319,161 B1 11/2001 Martinez et al.
6,390,642 B1 5/2002 Simonton
6,641,493 B1 * 11/2003 Shifflett ..... 473/578
6,663,518 B1 12/2003 Kuhn
6,695,727 B1 2/2004 Kuhn
2002/0151394 A1 10/2002 Arasmith

OTHER PUBLICATIONS http://www.arrowwraps.com; Bay Wholesalers:*Preston Performance—Graphics n Sign*—printed on Jul. 12, 2004 (2 pages).
http://www.decalnetwork.com/awinstall.htm; Bay Wholesalers:*Preston Performance—Graphics n Sign*—printed on Jul. 12, 2004 (1 page).
Cabela's Catalogue: (3 pages).

* cited by examiner

ARROW FLETCHING SYSTEM AND METHOD FOR ATTACHING ARROW FLETCHING SYSTEM TO AN ARROW SHAFT

BACKGROUND OF THE INVENTION

1. Field of the Invention

This invention relates generally to an arrow fletching system and a method for attaching the arrow fletching system to an archery arrow shaft. More particularly, this invention relates to a method for constructing an arrow fletching system having a shrinkable sleeve and at least one archery vane mounted to the sleeve, which can be secured about an end portion of the archery arrow shaft by shrinking the sleeve.

2. Discussion of Related Art

Many conventional archery arrows include fletching or archery vanes that are mounted on an arrow shaft to stabilize the flight of an archery arrow and to impart rotation on the arrow shaft during flight. The archery vanes are typically mounted directly to the arrow shaft at an aft end portion of the archery arrow using an adhesive material. Conventional fletching jigs are used to hold the arrow shaft and mount the archery vanes to the arrow shaft.

When the archery vanes are damaged, for example as a result of use, the damaged archery vanes must be replaced before the archery arrow can be used. The remaining portion of the damaged archery vane and/or the adhesive material used to mount the archery vane to the arrow shaft must be removed from the arrow shaft and the arrow shaft must be cleaned before attaching or mounting a replacement archery vane onto the arrow shaft. Further, a fletching jig is typically required to correctly position and attach the archery vanes onto the arrow shaft. Because the fletching process is time consuming and requires tools, such as a cumbersome fletching jig, hunters are not able to quickly and/or easily repair or fletch the damaged arrow in the field.

There is an apparent need for a fletching assembly that includes a shrinkable sleeve and at least one archery vane mounted on the shrinkable sleeve, and can be mounted and secured with respect to an archery arrow.

There is also an apparent need for a method for efficiently fitting or securing a fletching system with respect to an archery arrow.

Further, there is an apparent need for a fletching system that is easily securable to and/or removable from the arrow shaft.

SUMMARY OF THE INVENTION

A general object of this invention is to provide an improved fletching assembly that includes a shrinkable sleeve and at least one archery vane mounted to an outer surface of the shrinkable sleeve, which is easily securable to and/or removable from an arrow shaft.

Another object of this invention is to overcome one or more of the problems described above.

The above and other objects of this invention can be attained through a fletching system including a sleeve that is positionable about an outer surface of an arrow shaft. The sleeve preferably has an initial or preshrunk inner diameter greater than an outer diameter of the arrow shaft, so that the sleeve is slidably positionable about a portion of the arrow shaft. The fletching system also includes at least one, and preferably a plurality of archery vanes, mounted to an outer surface of the sleeve. For example, the fletching system may include three archery vanes mounted on the sleeve outer surface and evenly spaced about an outer circumference or periphery of the sleeve. Each archery vane can be mounted to the sleeve using any suitable mounting application. For example, each archery vane can be adhesively mounted to the sleeve outer surface or the archery vanes can be molded or integrated with the sleeve.

The archery vanes can be mounted to the sleeve so that a base portion of each archery vane is mounted parallel to a longitudinal axis of the arrow shaft, and the archery vane is aligned or mounted in a planar configuration with respect to the arrow shaft longitudinal axis. Alternatively, the archery vanes can be mounted to the sleeve so that the base portion of each archery vane is skewed or offset with respect to the arrow shaft longitudinal axis, and the archery vane is mounted in an unparallel or offset configuration, such as in a helical configuration with respect to the arrow shaft longitudinal axis.

Once the fletching assembly is positioned about the arrow shaft, as desired, the sleeve can be fitted or secured about the arrow shaft. For example, in one embodiment of this invention, the sleeve is made of a heat shrinkable material. Heat is applied to the sleeve to cause the sleeve to shrink about the arrow shaft to a shrunk condition that secures the fletching system to the arrow shaft. In the shrunk condition, the sleeve has a shrunk inner diameter less than the outer diameter of the arrow shaft. In one preferred embodiment of this invention, the sleeve can be submerged in heated or boiling water to shrink the sleeve onto an aft end portion of the arrow shaft. Other heat shrink systems or other suitable applications known to those skilled in the art and guided by the teachings herein provided can be used to fit or secure the fletching system to the arrow shaft.

The prior art generally fails to provide a fletching system having a shrinkable sleeve and at least one archery vane mounted to the outer surface of the sleeve, which is slidably positionable about an arrow shaft and fitable or securable about the arrow shaft.

In one preferred embodiment of this invention, the fletching system is constructed, assembled or made by fixing a shrinkable sleeve with respect to an expanding mandrel. The mandrel is activated to expand the shrinkable sleeve to a cylindrical shape. The mandrel can be activated pneumatically, mechanically, electrically and/or hydraulically. At least one archery vane, preferably a plurality of archery vanes are aligned with respect to an outer surface of the shrinkable sleeve, and the archery vanes are attached to the outer surface of the expanded shrinkable sleeve. Preferably, the archery vanes are adhesively attached to the outer surface of the shrinkable sleeve. The archery vanes can be aligned parallel with a longitudinal axis of the expanded shrinkable sleeve, or the archery vanes can be aligned helically with respect to the longitudinal axis of the expanded shrinkable sleeve.

Alternatively, in one preferred embodiment of this invention, the fletching system is constructed, molded or made using a multiple-shot molding process. First, a shrinkable sleeve is molded. Preferably, but not necessarily, during the shrinkable sleeve molding shot, a plurality of strakes are molded on the outer surface of the shrinkable sleeve. Subsequently, at least one archery vane is molded onto the shrinkable sleeve. During the archery vane molding process, the archery vanes can be aligned parallel to a longitudinal axis of the shrinkable sleeve, or the archery vanes can be aligned helically with respect to the shrinkable sleeve longitudinal axis. Further, in a subsequent shot of the multiple-shot molding process, a kicker can be molded onto at least one of the archery vane. The molded shrinkable sleeve is preferably stretched prior to molding the archery vanes onto the shrinkable sleeve outer surface, wherein an inner diameter of the shrinkable sleeve is increased during the stretching process.

The constructed or molded fletching system is slidably positionable about an outer surface of the arrow shaft. Preferably, the fletching system is positioned at an aft end portion of the arrow shaft. The fletching system is fitted or secured to the arrow shaft using a suitable application according to this invention. For example, the fletching system can be heated by placing the arrow shaft, having the fletching system slidably positioned with respect to the outer surface of the arrow shaft, in heated or boiling water to shrink the shrinkable sleeve and secure the fletching system about the arrow shaft. Before fitting or securing the fletching system about the arrow shaft, the archery vanes are preferably positioned in a parallel configuration with respect to the arrow shaft longitudinal axis of in a unparallel or helical configuration with respect to the arrow shaft longitudinal axis.

Other objects and advantages of this invention are apparent to those skilled in the art in view of the following detailed description taken in conjunction with the appended claims and drawings.

DETAILED DESCRIPTION OF THE INVENTION

This invention is directed towards a fletching system, which is securable with respect to an archery arrow shaft, and methods of constructing the fletching system. Further, this invention is directed towards a method for securing the fletching system with respect to the archery arrow shaft.

Figure 1:
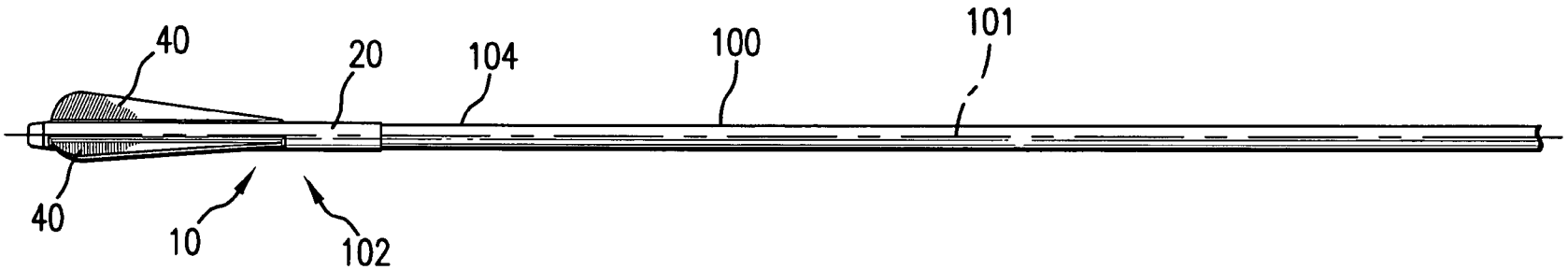
FIG. 1 is a side view of an aft end portion of an arrow shaft having a fletching system secured about the arrow shaft, according to one preferred embodiment of this invention.

In one preferred embodiment of this invention, fletching system 10 includes a sleeve 20 that is positionable about an outer surface of an arrow shaft 100, as shown in FIG. 1. Sleeve 20 of the present invention is securable to any arrow shaft material. For example, arrow shaft 100 may comprise a metal, an alloy, a plastic, a graphite and/or a composite material or any other suitable material. Sleeve 20 has a generally tubular configuration or shape with an initial or preshrunk inner diameter greater than an outer diameter of arrow shaft 100. Preferably, sleeve 20 is shrinkable to a shrunk condition that secures sleeve 20 with respect to arrow shaft 100. For example, sleeve 20 can be secured about an outer circumference or periphery of arrow shaft 100 by applying heat to sleeve 20. In the shrunk condition, sleeve 20 has a shrunk inner diameter less than the outer diameter of arrow shaft 100.

Sleeve 20 may comprise any suitable shrinkable material. Preferably, sleeve 20 is made of a heat shrinkable material, such as polyvinyl chloride, nylon, polytetrafluoroethylene or a polyolefin material. Additionally, sleeve 20 may be made of any suitable lightweight polymer, plastic or other material that can be secured to arrow shaft 100 using shrinking methods, including heat application, evaporation or other processes, which can cause the material to conform to the shape of arrow shaft 100. Alternatively, materials such as natural rubber or synthetic rubber, for example latex, which can stretch to conform to the shape of arrow shaft 100, can be used in accordance with this invention. Sleeve 20 can also be adhesively secured to arrow shaft 100.

Figure 2:
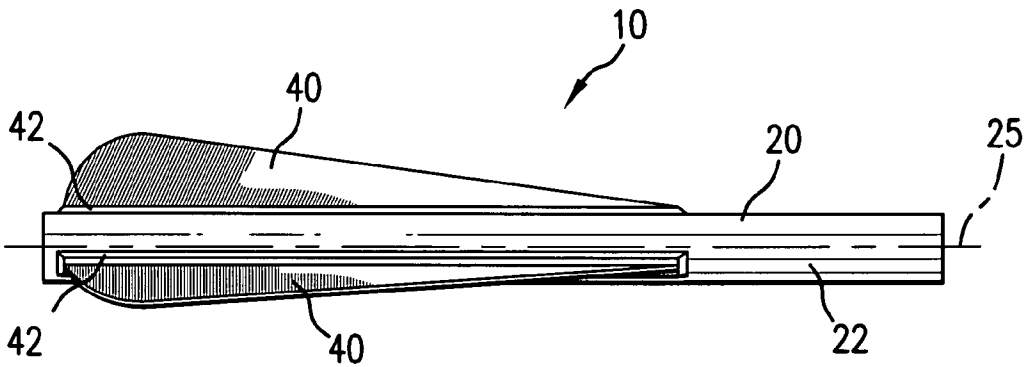
FIG. 2 is a side view of a fletching system, according to one preferred embodiment of this invention.
Figure 3:
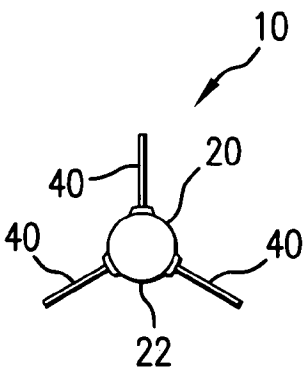
FIG. 3 a front view of a fletching system, according to one preferred embodiment of this invention.
Figure 4:
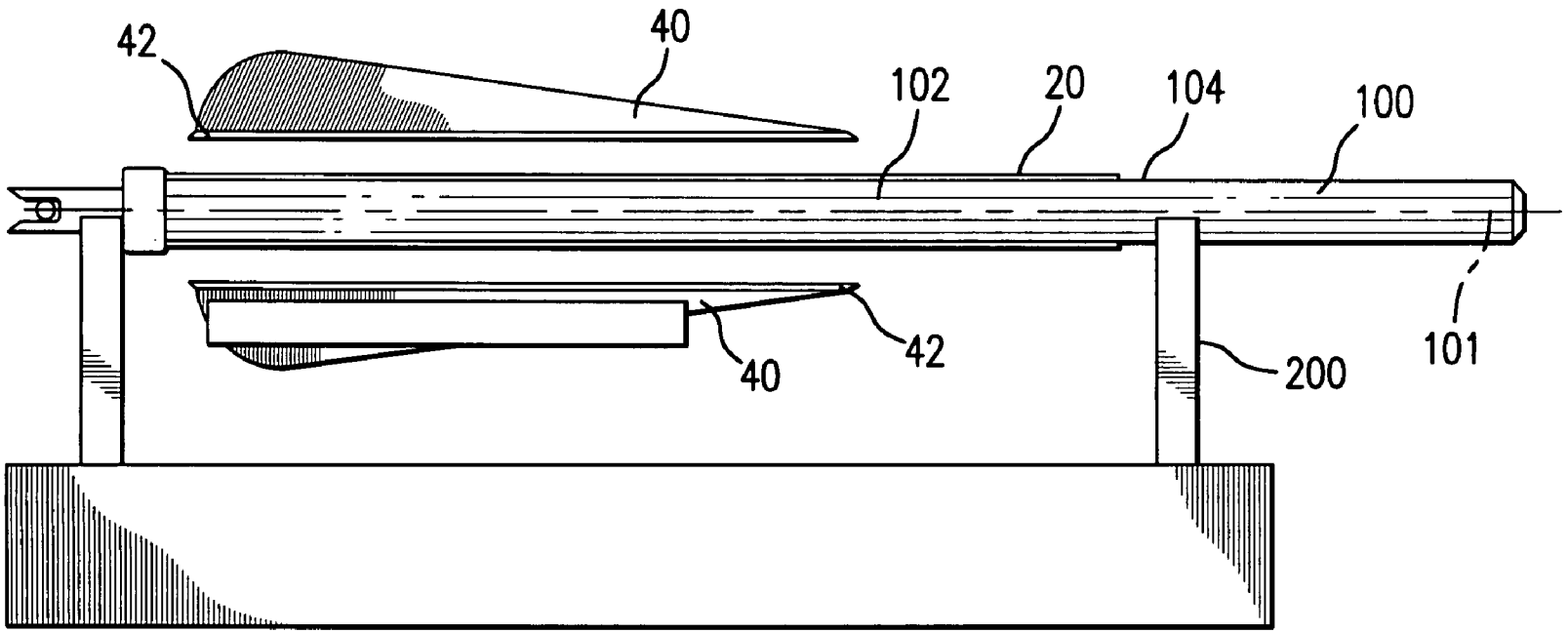
FIG. 4 is a side view of an arrow shaft positioned within a fletching jig for constructing a fletching system, according to one preferred embodiment of this invention.
Figure 5:
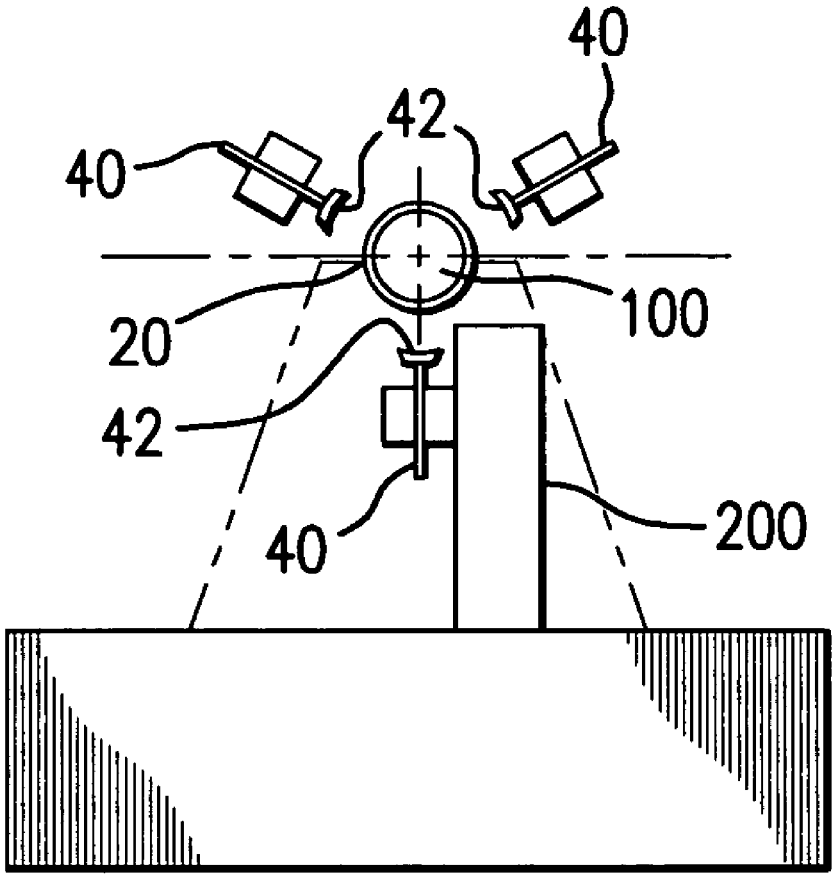
FIG. 5 is a front view of the arrow shaft of FIG. 4 positioned within the fletching jig for constructing the fletching system.

As shown in FIGS. 1–3, fletching system 10 includes at least one archery vane 40 mounted to an outer surface 22 of sleeve 20. Preferably, archery vane 40 is adhesively mounted to sleeve outer surface 22. Archery vane 40 can be mounted or attached to sleeve 20 using any suitable mounting or connecting methods. For example, as shown in FIGS. 4 and 5, arrow shaft 100 is positioned within a fletching jig 200, with sleeve 20 positioned about an aft end portion 102 of arrow shaft 100. Using fletching jig 200, archery vanes 40 can be aligned, positioned and/or mounted to sleeve 20, using an adhesive material.

Figure 6:
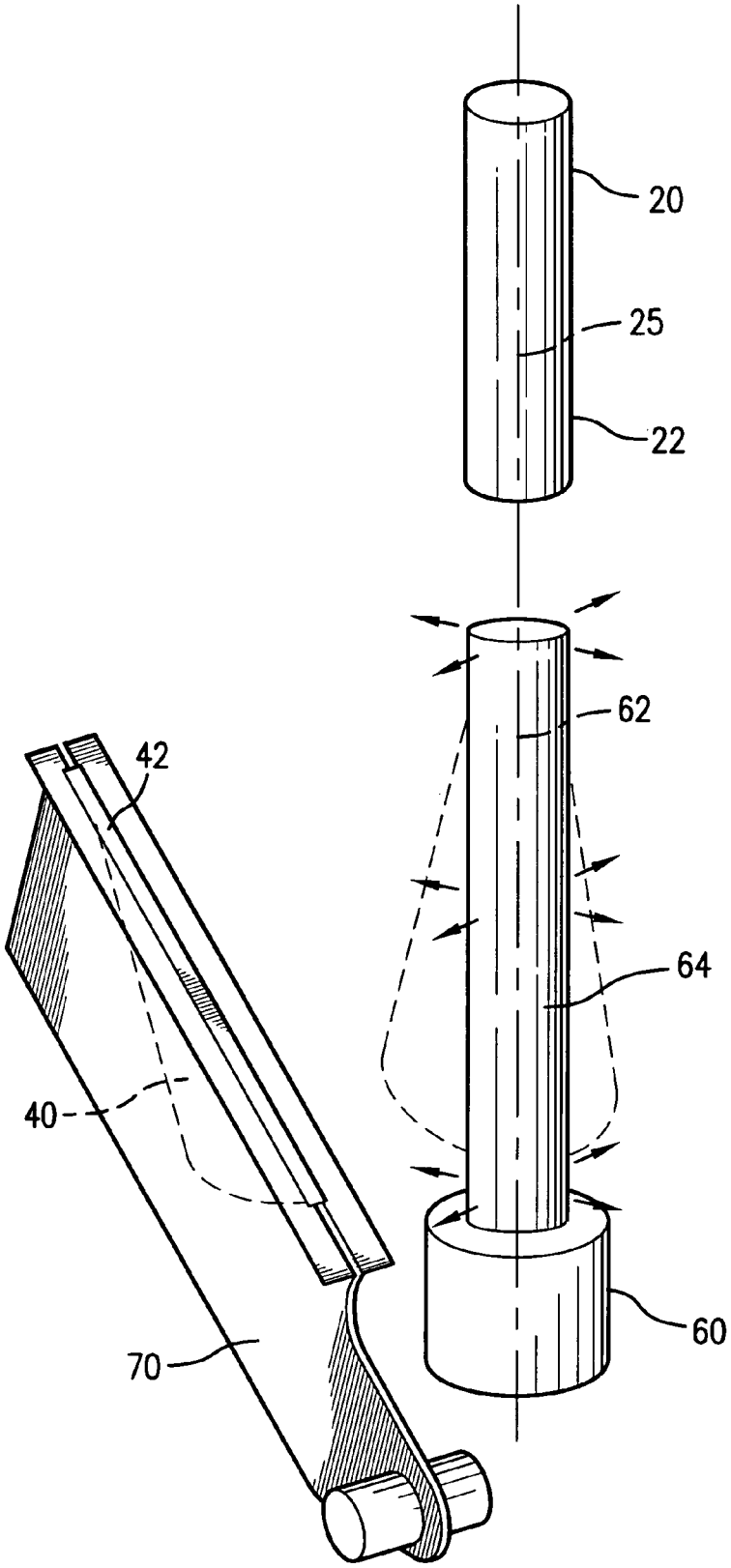
FIG. 6 illustrates a method for constructing a fletching system including an expandable mandrel, according to one preferred embodiment of this invention.

In one preferred embodiment of this invention, during the construction or assembly of fletching system 10, shrinkable sleeve 20 can be fixedly positioned on an expanding mandrel, as shown in FIG. 6 and described in greater detail below. The mandrel is activated pneumatically, mechanically, electrically and/or hydraulically to expand shrinkable sleeve 20 to a cylindrical shape. At least one archery vane 40 is aligned or positioned with respect to outer surface 22 of shrinkable sleeve 20, and adhesively attached, for example, to outer surface 22.

Figure 7:
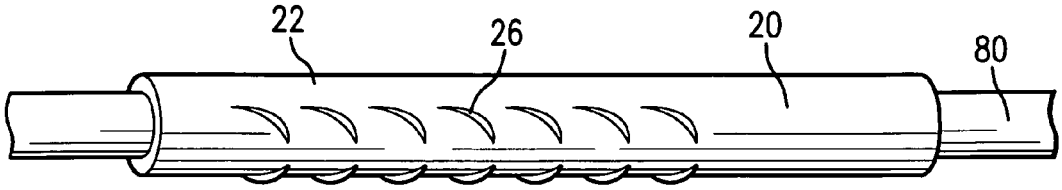
FIGS. 7–9 illustrate a method for molding a fletching system, according to one preferred embodiment of this invention.
Figure 8:
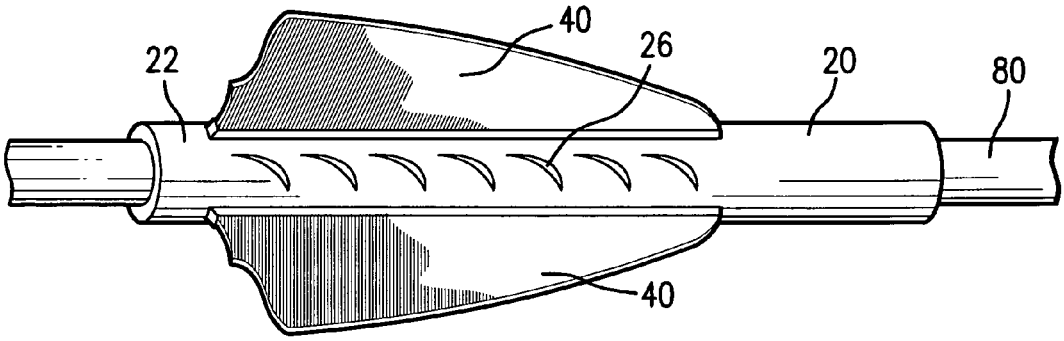
Figure 9:
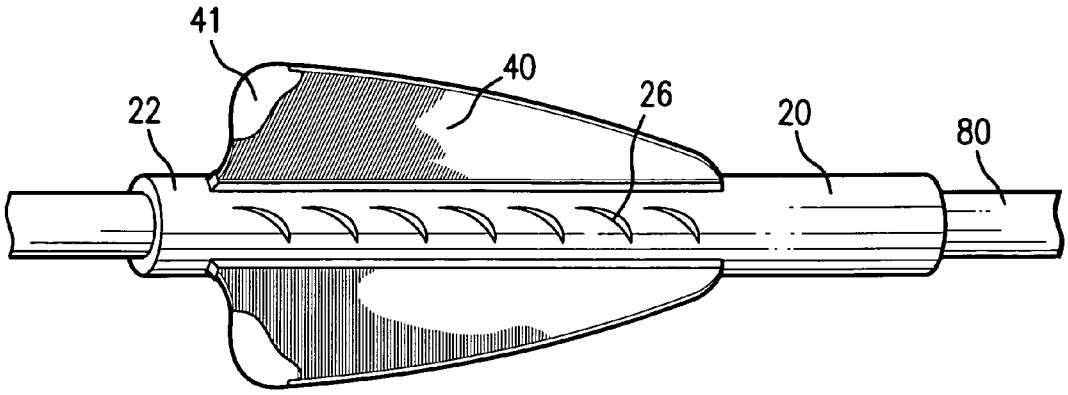

Alternatively, referring to FIGS. 7–9, archery vane 40 can be integrated or molded with sleeve 20. In one preferred embodiment of this invention, during the construction or molding of fletching system 10, shrinkable sleeve 20, including a plurality of strakes 26 on sleeve outer surface 22, is molded. The molded shrinkable sleeve 20 is stretched, wherein an inner diameter of sleeve 20 is preferably increased. At least one archery vane 40 is subsequently molded onto outer surface 22 of shrinkable sleeve 20. In an additional molding shot, a kicker 41 may be molded onto at least archery vane 40, as shown in FIG. 9. Preferably but not necessarily, each archery vane 40 includes a molded kicker 41.

Several preferred methods for attaching or connecting archery vanes 40 to sleeve 20 are disclosed in detail below in reference to constructing, molding or making fletching system 10. Preferably but not necessarily, a plurality of archery vanes 40, for example three archery vanes 40 as shown in FIG. 2, are mounted on sleeve outer surface 22. As shown in FIG. 2, archery vanes 40 are preferably equally spaced about a periphery or outer circumference of sleeve 20 and mounted to sleeve outer surface 22.

In one preferred embodiment of this invention, a base portion 42 of each archery vane 40 is parallel to a longitudinal axis 101 of arrow shaft 100 such that archery vane 40 extends radially outwardly from arrow shaft longitudinal axis 101 in an aligned or planar configuration, as shown in FIGS. 1 and 2. Alternatively, in one preferred embodiment of this invention, base portion 42 of each archery vane 40 is skewed or angled with respect to arrow shaft longitudinal axis 101 such that archery vane 40 is mounted in an unparallel or offset configuration, such as a helical configuration with respect to arrow shaft longitudinal axis 101.

Once fletching system 10 is constructed or molded, fletching system 10 can be attached or mounted with respect to arrow shaft 100. Sleeve 40 may include at least one archery vane 40 that is positioned in an aligned or planar configuration with respect to longitudinal axis 101 before or after positioning fletching system 10 about arrow shaft outer surface 104. Alternatively, sleeve 20 may include at least one archery vane 40 that is positioned in an unparallel or offset configuration, such as a helical configuration with respect to longitudinal axis 101 of arrow shaft 100 before or after fletching system 10 is positioned about arrow shaft outer surface 104.

In one preferred embodiment of this invention, fletching system 10 is slidably positioned about outer surface 104 and secured about arrow shaft 100. Preferably, sleeve 20 is made of a heat shrinkable material, such as polyvinyl chloride, nylon, polytetrafluoroethylene or a polyolefin material. Fletching system 10 is heated to shrink sleeve 20 and secure fletching system 10 about arrow shaft 100. For example, at least a portion of arrow shaft 100, having fletching system 10 slidably positioned with respect to outer surface 104, can be submerged in heated or boiling water to cause sleeve 20 to shrink about outer surface 104 and fit securely about arrow shaft 100. Preferably, the water has a temperature greater than the shrinking point of the sleeve material. For example, if sleeve 20 comprises polyvinyl chloride, the water preferably has a temperature greater than about 212° F., and if sleeve 20 comprises a polyolefin material, the water preferably has a temperature greater than about 158° F., to shrink sleeve 40 and secure fletching system 10 about arrow shaft 100. In one preferred embodiment of this invention, sleeve 40 has a final or shrunk wall thickness of about 0.010 inch to about 0.050 inch.

Referring to FIG. 6, fletching system 10 according to one preferred embodiment of this invention, can be constructed, assembled or made using an expandable mandrel 60. Preferably, at least a portion of mandrel 60 is expandable in a radially outwardly direction with respect to an axis 62 of mandrel 60, using any suitable expansion device. For example, mandrel 60 may be activated to expand pneumatically, mechanically, electrically and/or hydraulically.

Sleeve 20 is positioned and fixed with respect to a generally cylindrical portion 64 of mandrel 60. Mandrel 60 is activated such that cylindrical portion 64 expands radially outwardly to expand or stretch sleeve 20 into a cylindrical shape. Each archery vane 40 is positioned or aligned with respect to sleeve outer surface 22 using a fletching machine 70. Fletching machine 70 holds archery vane 40 such that base portion 42 can be positioned or aligned with outer surface 22 by movement of fletching machine 70 with respect to mandrel cylindrical portion 64. For example, fletching machine 70 can position a plurality of archery vanes 40 about cylindrical portion 64. Fletching machine 70 is pivotally movable with respect to mandrel 60 to position or align archery vanes 40 about outer surface 22 such that base portion 42 of each archery vane 40 contacts outer surface 22.

Archery vanes 40 are then attached or mounted to outer surface 22 of the expanded shrinkable sleeve 20, for example using an adhesive material. Base portion 42 of each archery vane 40 can be aligned parallel with a longitudinal axis 25 of the expanded shrinkable sleeve 20, which generally corresponds with mandrel axis 62. Alternatively, base portion 42 of each archery vane 40 can be aligned helically or unparallel with respect to longitudinal axis 25 of the expanded shrinkable sleeve 20.

Alternatively, referring to FIGS. 7–9, fletching system 10 according to one preferred embodiment of this invention can be constructed, molded or made using a multiple-shot molding process, wherein a shrinkable sleeve 20 is molded and at least one archery vane 40 is subsequently molded onto an outer surface 22 of shrinkable sleeve 20. Sleeve 20 and/or archery vanes 40 can be molded using any suitable molding apparatus, device and/or die. For example, sleeve 20 may be molded using a mandrel, schematically illustrated in FIGS. 7–9 and generally referenced by element reference number 80.

Sleeve 20 is formed or molded about mandrel 80 during a first shot of the multiple-shot molding process. Preferably, as shown in FIG. 7, a plurality of strakes 26 are molded on outer surface 22 of shrinkable sleeve 20, as shrinkable sleeve 20 is molded. Strakes 26 can be molded in any suitable configuration and/or shape. As shown in FIG. 7, strakes 26 can be formed in a plurality of lines or rows positioned about a periphery or outer surface 22 of sleeve 20.

At least one archery vane 40, and preferably a plurality of evenly-spaced archery vanes 40, are molded onto sleeve 20 in a subsequent shot of the multiple-shot process. As shown in FIG. 8, at least one row of strakes 26 is positioned between adjacent molded archery vanes 40. Base portion 42 of each archery vane 40 can be aligned parallel to shrinkable sleeve longitudinal axis 25. Alternatively, base portion 42 of each archery vane 40 can be aligned helically or unparallel with respect to shrinkable sleeve longitudinal axis 25.

Prior to molding archery vanes 40 onto outer surface 22 of shrinkable sleeve 20, the molded shrinkable sleeve 20 is preferably stretched. For example, during the multiple-shot molding process, the molded shrinkable sleeve 20 is removed from mandrel 80, on which shrinkable sleeve 20 is molded. The molded shrinkable sleeve 20 is stretched and then repositioned on mandrel 80 before molding archery vane 40 onto shrinkable sleeve outer surface 22. Preferably, an inner diameter of shrinkable sleeve 20 is increased during the stretching process.

During a subsequent shot of the multiple-shot molding process, a spinning element or component, such as kicker 41, can be molded onto each archery vane 40, as shown in FIG. 9. Suitable spinning elements, including kickers, are disclosed in U.S. Pat. No. 6,142,896 issued to Simo et al. on 7 Nov. 2000, the entire disclosure of which is incorporated herein by reference.

Thus, this invention provides a fletching system having a shrinkable sleeve and at least one archery vane mounted to the outer surface of the sleeve. The fletching system is slidably positionable about an arrow shaft and fitable or securable to the arrow shaft. The fletching system is easily securable to the arrow shaft, for example by applying heat to the heat shrinkable sleeve, to conform the sleeve to the outer surface of the arrow shaft. Further, the fletching system is easily removable from about the arrow shaft by cutting the sleeve along a length of the sleeve, for example using a knife or scissors.

This invention as illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that this invention is susceptible to additional embodiments and that certain of the details described herein can be varied considerably without departing from the basic principles of this invention.

What is claimed is:

1. A method for attaching a fletching system with respect to an arrow shaft comprising, in the consecutive steps:

a) constructing a fletching system by expanding a shrinkable sleeve and mounting at least one archery vane on an outer surface of the expanded shrinkable sleeve;

b) slidably positioning the constructed fletching system about an outer surface of the arrow shaft; and c) securing the constructed fletching system about the arrow shaft.

2. The method of claim 1 wherein during the construction step, the at least one archery vane is adhesively secured to an outer surface of the shrinkable sleeve.

3. The method of claim 1 wherein heat is applied to shrink the shrinkable sleeve and secure the fletching system about the arrow shaft.

4. The method of claim 1 wherein the fletching system is placed in water to shrink the shrinkable sleeve and secure the fletching system about the arrow shaft.

5. The method of claim 1 wherein the at least one archery vane is positioned in a helical configuration with respect to a longitudinal axis of the arrow shaft before positioning the fletching system about the arrow shaft outer surface.

6. The method of claim 1 wherein the at least one archery vane is positioned in a planar configuration with respect to a longitudinal axis of the arrow shaft before positioning the fletching system about the arrow shaft outer surface.

7. The method of claim 1 wherein the construction step further comprises:

fixing the shrinkable sleeve on an expanding mandrel;

activating the mandrel to expand the shrinkable sleeve to a cylindrical shape;

aligning the at least one archery vane with respect to the outer surface of the shrinkable sleeve; and attaching the at least one archery vane to the outer surface of the expanded shrinkable sleeve.

8. The method of claim 7 wherein a base portion of the at least one archery vane is aligned parallel with respect to a longitudinal axis of the expanded shrinkable sleeve.

9. The method of claim 7 wherein a base portion of the at least one archery vane is positioned unparallel with respect to a longitudinal axis of the expanded shrinkable sleeve.

10. The method of claim 7 wherein the at least one archery vane is adhesively attached to the outer surface of the expanded shrinkable sleeve.

11. The method of claim 1 wherein the construction step further comprises:

molding the shrinkable sleeve; and molding the at least one archery vane onto the outer surface of the shrinkable sleeve.

12. The method of claim 11 wherein a plurality of strakes are molded on an outer surface of the shrinkable sleeve.

13. The method of claim 11 further comprising the step of stretching the molded shrinkable sleeve prior to molding the at least one archery vane onto the outer surface of the shrinkable sleeve.

14. The method of claim 13 wherein an inner diameter of the shrinkable sleeve is increased during the stretching process.

15. The method of claim 11 wherein a kicker is molded onto the at least one archery vane.

16. The method of claim 11 further comprising the steps of:

removing the molded shrinkable sleeve from a mandrel;

stretching the molded shrinkable sleeve; and repositioning the molded shrinkable sleeve on the mandrel before molding the at least one archery vane on the outer surface of the shrinkable sleeve.

17. A method for constructing a fletching system comprising:

fixing a shrinkable sleeve with respect to an expanding mandrel;

activating the mandrel to expand the shrinkable sleeve to a cylindrical shape;

aligning at least one archery vane with respect to an outer surface of the shrinkable sleeve; and attaching the at least one archery vane to the outer surface of the expanded shrinkable sleeve.

* * * * *